US010051971B2

(12) United States Patent
Gordon

(10) Patent No.: US 10,051,971 B2
(45) Date of Patent: Aug. 21, 2018

(54) DUVET INSERTION DEVICE

(71) Applicant: Kristel Gordon, San Diego, CA (US)

(72) Inventor: Kristel Gordon, San Diego, CA (US)

( * ) Notice: Subject to any disclaimer, the term of this patent is extended or adjusted under 35 U.S.C. 154(b) by 0 days.

(21) Appl. No.: 15/524,945

(22) PCT Filed: Nov. 3, 2015

(86) PCT No.: PCT/US2015/058771
§ 371 (c)(1),
(2) Date: May 5, 2017

(87) PCT Pub. No.: WO2016/073439
PCT Pub. Date: May 12, 2016

(65) Prior Publication Data

US 2017/0332801 A1 Nov. 23, 2017

Related U.S. Application Data

(60) Provisional application No. 62/075,379, filed on Nov. 5, 2014.

(51) Int. Cl.
*A47C 21/02* (2006.01)
*A47G 9/02* (2006.01)

(52) U.S. Cl.
CPC ..... *A47C 21/02* (2013.01); *A47G 9/0207* (2013.01)

(58) Field of Classification Search
CPC ..... A47C 21/02
USPC ..... 5/498, 482, 499–501
See application file for complete search history.

(56) References Cited

U.S. PATENT DOCUMENTS 2,326,399 A * 8/1943 Shields ..... A47C 21/022 24/72.5
4,782,543 A * 11/1988 Hutton ..... A47C 21/022 24/72.5

* cited by examiner

*Primary Examiner* — Fredrick C Conley
(74) *Attorney, Agent, or Firm* — Jay B Bell

(57) ABSTRACT

A device and related method for enabling a single user to facilitate the insertion of a duvet into a duvet cover is described. The duvet holder comprises an engagement element that is individually connected to a corresponding purchase element by way of a strap. Preferably, the user employs two duvet holders at the same time, and arranges them such that the purchase elements are placed underneath two adjacent corners of the mattress at the headboard end of the bed and the respective connected engagement elements are laid on top of the mattress. Assembled duvet/duvet cover corners are inserted into the engagement elements that securely grip the assembled corners while the purchase elements act as resistive anchors to limit movement of the duvet. The user then extends the cover over the rest of the duvet.

20 Claims, 5 Drawing Sheets

DUVET INSERTION DEVICE

CROSS-REFERENCES TO RELATED APPLICATIONS

This application is a non-provisional application claiming the benefit of priority from U.S. Provisional Patent Application Ser. No. 62/075,379 filed on Nov. 5, 2014, the entire content of which is hereby expressly incorporated by reference into this disclosure as if set forth fully herein.

FIELD

This disclosure relates to a device and method for inserting and fitting a duvet inside its cover.

BACKGROUND

While performing the procedure of inserting and fitting a duvet in its cover, it is generally required that an assistant be present to hold one end of the duvet while the user extends the cover over the rest of the duvet. In the event where a user does not have an assistant available to aid in inserting and fitting a duvet in its cover, the task can become a nuisance and very difficult, and can also cause discomfort for the user from the physical exertion required.

Several methods have been proposed and some devices constructed to facilitate the process of inserting and fitting a duvet in its cover. Many prior art devices require static objects such as headboards, bed posts, doors, hooks, and/or clips that are permanently secured to a wall, as a means to fix the duvet and/or cover and complete the task. This is not always practical or preferable if the user does not readily have available such static objects. Other proposed devices are complicated to use, requiring involved assembly, adjustments, or lengthy set-up time before use to accomplish the task.

The present disclosure describes a device and method that addresses and resolves the above issues encountered when inserting and fitting a duvet into its cover.

SUMMARY OF THE DISCLOSURE

The present disclosure addresses the issues with the prior art devices by describing a duvet holder that is a standalone and one-size-fits-all solution suitable for all duvet and mattress sizes. It allows the user to insert and fit a duvet into its cover without the use of clips or surrounding static objects as described above. Furthermore, the example duvet holder described herein is provided to the user ready to be used without complex assembly or prolonged setup time, and provides the user with the ability to change a duvet without the assistance of another person.

By way of example, the duvet holder of the present disclosure comprises an engagement element that is individually connected to a corresponding purchase element by way of a strap. Preferably, the user employs two duvet holders at the same time, and arranges them such that the purchase element of the first duvet holder is placed underneath one corner of the mattress at the headboard end of the bed and the connected engagement element is laid on top of the mattress. Similarly, the purchase element of the second duvet holder is placed underneath the other corner of the mattress at the headboard end of the bed and the connected engagement element is laid on top of the mattress. A first corner of the duvet is inserted into its corresponding corner of the duvet cover to form a first assembled corner, and then the first assembled corner is inserted into the engagement element of the first duvet holder. A second corner of the duvet is inserted into its corresponding corner of the duvet cover to form a second assembled corner, and then the second assembled corner is inserted into the engagement element of the second duvet holder. When used thusly as a pair, the engagement elements securely grip the assembled corners while the purchase elements act as resistive anchors to limit movement of the duvet. The user's hands are then free to extend the cover over the rest of the duvet.

The duvet holder of the present disclosure is a stand-alone system that uses the height and weight of the mattress itself. The duvet holder does not require any other devices to function such as surrounding fixtures that might be readily available to the user. The present duvet holder is ready to be used as soon as a user obtains it. It does not require complex assembly or prolonged setup time before use, which increases speed and efficiency to complete the task. The design of the engagement elements and straps make the duvet holder described herein versatile by being able to accommodate any range of duvet widths and mattress thicknesses without the need for adjustments. Furthermore, engagement elements are suitable for use by any user regardless of age and physical strength. Finally, because of its generally flat configuration, the duvet holder can be conveniently stored under the mattress and easily retrieved for future use.

By way of example, the duvet holder includes a first shaped end, a second shaped end, and a connector extending axially between the first and second shaped ends. The first shaped end includes a purchase element that engages the mattress and maintains the duvet holder in the desired position during use. The second shaped end includes an engagement element configured to temporarily hold a duvet and/or duvet cover in place during use.

The first shaped end is preferably flat in configuration so as to lie flat underneath the mattress both during use and for storage purposes. By way of example, the first shaped end includes a purchase element and a first end frame. In the example shown and described herein, the first end frame has a substantially rectangular shape with a bottleneck configuration. More specifically, the first end frame has a pair of elongated lateral sides, a distal side (comprising a first end of the duvet holder), and a proximal side that surround the purchase element and define the perimeter of the first shaped end. The lateral sides are generally straight and parallel to one another. The distal side is generally straight and perpendicular to the lateral sides. The proximal side tapers toward the general middle of the proximal side, where the strap intersects the first shaped end. Although the first end frame is shown and described herein as having a rectangular shape with bottleneck configuration, other shapes and/or configurations are possible including but not limited to geometric shapes (e.g. square, rectangular, triangular, circular, elliptical, etc.) and organic shapes (e.g. irregular, free-form, etc), so long as the first shaped end is capable of frictionally engaging the mattress to prevent slippage of the purchase element during use. The first end frame may be comprised of neoprene material, however other materials may be used including (but not limited to) resilient and flexible materials. Furthermore, the first shaped end may comprise a purchase element only without a first end frame.

By way of example, the purchase element comprises a double-sided purchase element that is the same on both sides to enable the duvet holder to be used with either side facing up. In the embodiment described herein by way of example, the purchase element comprises a frictional non-slip surface having a substantially rectangular shape with a raised dome configuration, however other shapes and/or configurations are possible including but not limited to geometric shapes (e.g. square, rectangular, triangular, circular, elliptical, etc.), organic shapes (e.g. irregular, free-form, etc), and substantially flat configurations. The purchase element is made of a frictional non-slip material that prevents slippage of the first shaped end during use, for example including but not limited to non-woven nylon fabric material, PVC foam, TPE foam, un-backed neoprene, EVA foam, and the like. In the example embodiment described herein, the purchase element is preferably integrally formed with the first end frame, however it should be appreciated that the purchase element may be formed independent of the first end frame and then attached to the first end frame by any suitable attachment method, including but not limited to stitching, adhesive, snap-fit, screws, nails, rivets, and pins.

The second shaped end is preferably flat in configuration so as to lie flat underneath the mattress for storage purposes. By way of example, the second shaped end includes an engagement element and a second end frame. In the example shown and described herein, the second end frame has a substantially rectangular shape with a bottleneck configuration. More specifically, the second end frame has a pair of elongated lateral sides, a distal side (comprising a second end of the duvet holder), and a proximal side. The lateral sides are generally straight and parallel to one another. The distal side is generally straight and perpendicular to the lateral sides. The proximal side tapers toward the general middle of the proximal side, where the strap intersects the second shaped end. Although the second end frame is shown and described herein as having a rectangular shape with bottleneck configuration, other shapes and/or configurations are possible including but not limited to geometric shapes (e.g. square, rectangular, triangular, circular, elliptical, etc.) and organic shapes (e.g. irregular, free-form, etc), so long as the second shaped end is capable of securely engaging the duvet cover to hold the duvet cover during use. The second end frame is preferably made of a similar material to the first end frame and the strap, however other materials may be used without departing from the scope of this disclosure. As with the first shaped end, the second shaped end may comprise an engagement element only without a second end frame.

The engagement element is configured to temporarily hold a duvet and/or duvet cover in place during use. The engagement element comprises an enlarged aperture, an axial slit, and a lateral slit that work in concert to temporarily receive and securely hold the duvet and/or duvet cover in place during use. Preferably, the aperture, axial slit, and lateral slit each extend completely through the engagement element such that the duvet holder may be used with either side facing up. In the example shown, the engagement element is configured such that the aperture is positioned nearest the proximal side and the lateral slit is positioned nearest the distal side. The axial slit is connected to and extends continuously between the enlarged aperture and the lateral slit. The axial slit is preferably centered within the engagement element and is parallel to the lateral sides. The axial slit is preferably perpendicular to and connects to the center of the lateral slit. Although the engagement element is shown and described herein as having an enlarged aperture axial slit, and lateral slit, other engagement mechanisms are possible, including but not limited to a clip, a post (that engages with a loop attached to the duvet and/or the duvet cover), a hook-and-loop fastener (configured to mate with a corresponding hook-and-loop fastener provided on the duvet and/or duvet cover), and the like.

By way of example only, the engagement element may be made of a polypropylene material, however other materials may be used in the manufacture of the engagement element without departing from the scope of the disclosure, including but not limited to resilient and flexible materials (e.g. Acrylonitrile Butadiene Styrene Plastic). In the example embodiment described herein, the engagement element is preferably integrally formed with the second end frame, however it should be appreciated that the engagement element may be formed independent of the second end frame and then attached to the second end frame by any suitable attachment method, including but not limited to stitching, adhesive, snap-fit, screws, nails, rivets, and pins.

The strap has an elongated configuration and functions as a connector between the first shaped end and the second shaped end. By way of example, the strap has a length suitable to accommodate any of a variety of common mattress thicknesses. Alternatively, the duvet holder may be provided in several versions each having a strap of a different length. In a further alternative embodiment, the strap may be adjustable in length. The strap is preferably made of a material that is similar to the first end frame and/or second end frame, however other materials may be used, for example including but not limited to plastic, rubber, nylon, canvas, and the like. In the example shown, the strap is integrally formed with the first and second end frames, however as an alternative embodiment the strap may be formed independent of the first and/or second end frames and subsequently attached to the first and/or second end frames by any suitable attachment configuration, including but not limited to stitching, adhesive, screws, pins, nails, rivets, and the like. Furthermore, in alternative embodiments the duvet holder may be formed without the first and/or second end frames. In such embodiments, the strap may be integrally formed with the first and/or second shaped ends. Alternatively the strap may be formed independent of the first and/or second shaped ends and subsequently attached to the first and/or second shaped ends by any suitable attachment configuration, including but not limited to stitching, adhesive, screws, pins, nails, rivets, and the like. As a further alternative, the strap may be integrally formed with one of the first and second shaped ends, and formed independent of (and subsequently attached to) the other of the first and second shaped ends.

Although the above disclosure pertained to a single duvet holder, the preferred use includes a pair of identical duvet holders used in concert. The first shaped end (including purchase element) of a first duvet holder is placed underneath one corner of the mattress at the end of the bed near the headboard. By way of example, this placement may be between the mattress and a box spring, or the mattress and a bed frame, if applicable. Similarly, the first shaped end (including purchase element) of a second duvet holder is paced underneath the other corner of the mattress at the headboard end of the bed. The corresponding second shaped ends (with engagement features) are placed on top of the mattress by the headboard in their respective corners of the bed. Proper placement of the engagement elements by the headboard and the prevention of excessive slack in the straps can be resolved by pulling the purchase elements down and away from the headboard under the mattress. After the duvet holders are in position, the user then prepares the duvet and duvet cover by inserting two corners of the duvet into the corresponding corners of the duvet cover to form first and second assembled corners. The first assembled corner is pulled through the enlarged aperture of the engagement element of one of the duvet holders until enough of the duvet/duvet cover combination extends beyond the plane of the second shaped end. The user then continues to pull first assembled corner downward through the axial slit until it is snuggly secured in the lateral slit. The process is repeated for the second assembled corner. When both the first and second assembled corners of the duvet have been secured in the engagement elements, the duvet cover can be extended over the rest of the duvet in the conventional fashion. When the duvet cover has been fully extended over the duvet, the secured assembled corners can be removed from the engagement element by pulling each assembled corner up and through the axial slit and out of the aperture. The duvet holder can then be tucked and stored away underneath the mattress until it is needed again.

According to one embodiment, there is a holder for securely holding one corner of a duvet inserted into one corner of a duvet cover in place on a mattress to facilitate insertion of the entire duvet into the duvet cover. The holder comprises a first end portion, a second end portion, and an elongated connector extending between the first and second end portions. The first end portion is configured for placement underneath a mattress and includes a purchase element that interfaces with the mattress to prevent the first end portion from moving relative to the mattress. The second end portion is configured for placement on top of a mattress and includes an engagement element configured to temporarily securely receive therein a portion of a duvet inserted into a duvet cover.

According to one embodiment, the first end portion of the holder comprises a first shaped end having a width dimension greater than the width dimension of the elongated connector.

According to one embodiment, the first end portion further includes a frame surrounding the purchase element and defining a perimeter of the first end portion.

According to one embodiment, the first end portion is integrally formed with the elongated connector.

According to one embodiment, the purchase element comprises a frictional non-slip material that employs frictional force to gain purchase relative to the mattress. The frictional non-slip material may comprise non-woven nylon fabric material and/or PVC foam and/or TPE foam and/or un-backed neoprene and/or EVA foam.

According to one embodiment, the second end portion of the holder comprises a second shaped end having a width dimension greater than the width dimension of the elongated connector.

According to one embodiment, the second end portion further includes a frame surrounding the engagement element and defining a perimeter of the second end portion.

According to one embodiment, the second end portion is integrally formed with the elongated connector.

According to one embodiment, the engagement element comprises an enlarged aperture, an axial slit, and a lateral slit that work in concert to temporarily receive and securely hold the duvet and duvet cover in place during use. By way of example, the enlarged aperture is positioned nearest the elongated connector, the lateral slit is positioned near an outer edge, and the axial slit is connected to and extends between the enlarged aperture and the lateral slit.

According to one embodiment, the engagement element is made of a flexible, resilient material. The flexible, resilient material may comprise polypropylene material and/or acrylonitrile butadiene styrene plastic.

According to another embodiment, there is a method for inserting a duvet into a duvet cover. A first step of the method is positioning a first removable duvet holder on a mattress. The first removable duvet holder includes a first end portion, a second end portion, and an elongated connector extending between the first and second end portions. The first end portion includes a purchase element that interfaces with a mattress to prevent the first end portion from moving relative to the mattress. The second end portion includes an engagement element configured to temporarily securely receive therein at least a portion of the duvet inserted into the duvet cover. The first removable duvet holder is positioned such that the first end portion including the purchase element is underneath a first corner of the mattress, and the second end portion including the engagement element is on top of the mattress near the first corner.

A second step of the method is positioning a second removable duvet holder on a mattress. The second removable duvet holder includes a first end portion, a second end portion, and an elongated connector extending between the first and second end portions. The first end portion includes a purchase element that interfaces with a mattress to prevent the first end portion from moving relative to the mattress. The second end portion includes an engagement element configured to temporarily securely receive therein at least a portion of the duvet inserted into the duvet cover. The second removable duvet holder is positioned such that the first end portion including the purchase element is underneath a second corner of the mattress, and the second end portion including the engagement element is on top of the mattress near the second corner;

A third step of the method is preparing the duvet and duvet cover by inserting a first corner of the duvet into a first corner of the duvet cover to form a first assembled corner, and inserting a second corner of the duvet into a second corner of the duvet cover to form a second assembled corner.

A fourth step of the method is temporarily attaching the first assembled corner to the engagement element of the first removable duvet holder.

A fifth step of the method is temporarily attaching the second assembled corner to the engagement element of the second removable duvet holder.

A sixth step of the method is extending the remaining portion of the duvet cover over the remaining portion of the duvet so that a third corner of the duvet is inserted into a third corner of the duvet cover and a fourth corner of the duvet is inserted into a fourth corner of the duvet cover.

According to one embodiment, the engagement element of the first duvet holder comprises a first enlarged aperture, a first axial slit, and a first lateral slit that work in concert to temporarily receive and securely hold the first assembled corner in place during use. The first enlarged aperture is positioned nearest the elongated connector, the first lateral slit is positioned near an outer edge, and the first axial slit is connected to and extends between the first enlarged aperture and first lateral slit. The step of temporarily attaching the first assembled corner to the engagement element of the first removable duvet holder comprises pulling the first assembled corner through the first enlarged aperture, first axial slit, and first lateral slit until the first assembled corner is snugly secured within the first lateral slit.

According to one embodiment, the engagement element of the second duvet holder comprises a second enlarged aperture, a second axial slit, and a second lateral slit that work in concert to temporarily receive and securely hold the second assembled corner in place during use. The second enlarged aperture is positioned nearest the elongated connector, the second lateral slit is positioned near an outer edge, and the second axial slit is connected to and extends between the second enlarged aperture and second lateral slit. The step of temporarily attaching the second assembled corner to the engagement element of the second removable duvet holder comprises pulling the second assembled corner through the second enlarged aperture, second axial slit, and second lateral slit until the second assembled corner is snugly secured within the second lateral slit.

A seventh step of the method comprises the step of disengaging the assembled duvet and duvet cover from the first and second removable duvet holders after the step of extending the remaining portion of the duvet cover over the remaining portion of the duvet has been completed by disassociating the first assembled corner from the engagement element of the first removable duvet holder and disassociating the second assembled corner from the engagement element of the second removable duvet holder.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DETAILED DESCRIPTION OF A PREFERRED EMBODIMENT

Figure 1:
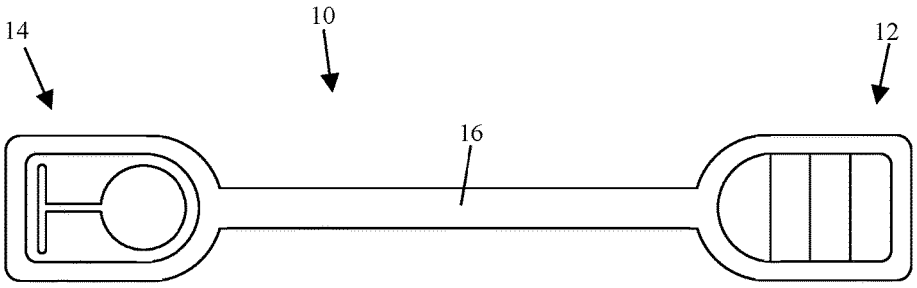
FIG. 1 is a top plan view of one example of a duvet holder according to the present disclosure.
Figure 2:
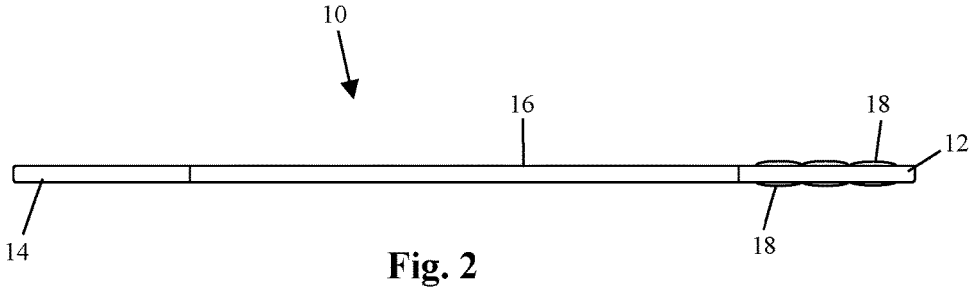
FIG. 2 is a side plan view of the duvet holder of FIG. 1.

FIGS. 1 and 2 illustrate an example of a duvet holder 10 according to one embodiment of the disclosure. By way of example, the duvet holder 10 includes a first shaped end 12, a second shaped end 14, and a connector 16 extending axially between the first and second shaped ends 12, 14. The first shaped end 12 includes a purchase element 18 that engages the mattress and maintains the duvet holder 10 in the desired position during use. The second shaped end 14 includes an engagement element 20 configured to temporarily hold a duvet and/or duvet cover in place during use.

Figure 3:
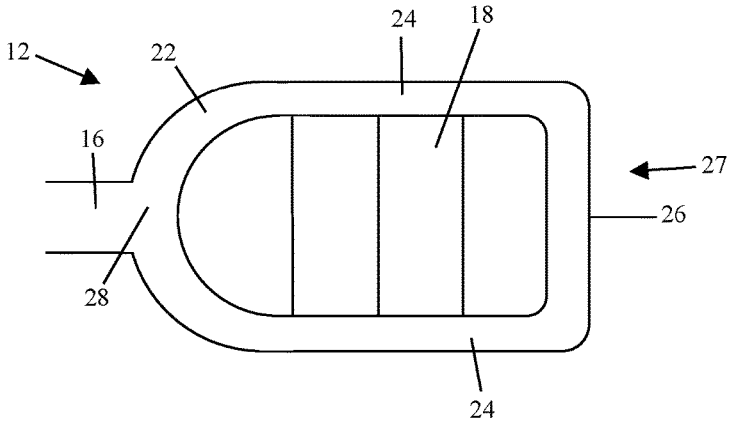
FIG. 3 is an enlarged plan view of a first shaped end forming part of the duvet holder of FIG. 1.

The first shaped end 12 (shown in greater detail in FIG. 3) is preferably flat in configuration so as to lie flat underneath the mattress both during use and for storage purposes. By way of example, the first shaped end 12 includes a purchase element 18 and a first end frame 22. In the example shown and described herein, the first end frame 22 has a substantially rectangular shape with a bottleneck configuration. More specifically, the first end frame 22 has a pair of elongated lateral sides 24, a distal side 26 (comprising a first end 27 of the duvet holder 10), and a proximal side 28 that surround the purchase element 18 and define the perimeter of the first shaped end 12. The lateral sides 24 are generally straight and parallel to one another. The distal side 26 is generally straight and perpendicular to the lateral sides 24. The proximal side 28 tapers toward the general middle of the proximal side, where the strap 16 intersects the first shaped end 12. Although the first end frame 22 is shown and described herein as having a rectangular shape with bottleneck configuration, other shapes and/or configurations are possible including but not limited to geometric shapes (e.g. square, rectangular, triangular, circular, elliptical, etc.) and organic shapes (e.g. irregular, free-form, etc), so long as the first shaped end 12 is capable of frictionally engaging the mattress to prevent slippage of the purchase element 18 during use. The first end frame 22 may be comprised of neoprene material, however other materials may be used including (but not limited to) resilient and flexible materials. Furthermore, the first shaped end 12 may comprise a purchase element 18 only without a first end frame 22.

By way of example, the purchase element 18 comprises a double-sided purchase element 18 that is the same on both sides to enable the duvet holder 10 to be used with either side facing up. In the embodiment described herein by way of example, the purchase element 18 comprises a frictional non-slip surface having a substantially rectangular shape with a raised dome configuration, however other shapes and/or configurations are possible including but not limited to geometric shapes (e.g. square, rectangular, triangular, circular, elliptical, etc.), organic shapes (e.g. irregular, free-form, etc), and substantially flat configurations. The purchase element 18 is made of a frictional non-slip material that prevents slippage of the first shaped end 12 during use, for example including but not limited to non-woven nylon fabric material, PVC foam, TPE foam, un-backed neoprene, EVA foam, and the like. In the example embodiment described herein, the purchase element 18 is preferably integrally formed with the first end frame 22, however it should be appreciated that the purchase element 18 may be formed independent of the first end frame 22 and then attached to the first end frame 22 by any suitable attachment method, including but not limited to stitching, adhesive, snap-fit, screws, nails, rivets, and pins.

Figure 4:
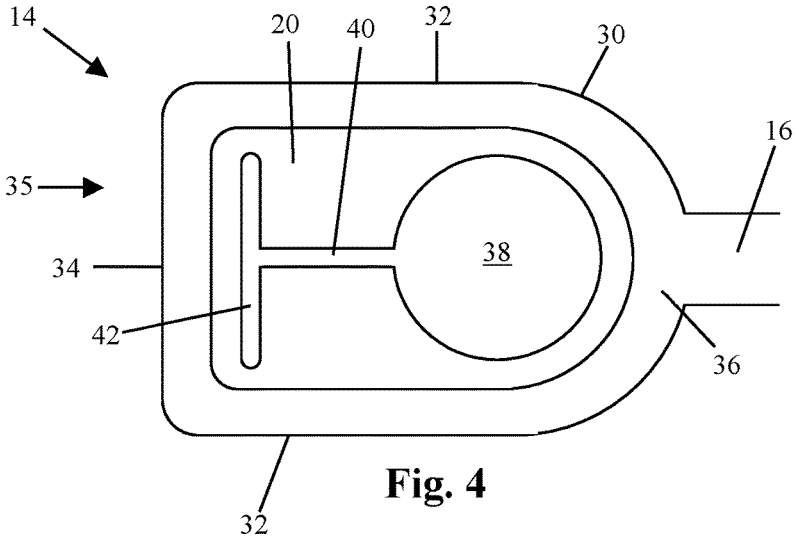
FIG. 4 is an enlarged plan view of a second shaped end forming part of the duvet holder of FIG. 1.

The second shaped end 14 (shown in greater detail in FIG. 4) is preferably flat in configuration so as to lie flat underneath the mattress for storage purposes. By way of example, the second shaped end 14 includes an engagement element 20 and a second end frame 30. In the example shown and described herein, the second end frame 30 has a substantially rectangular shape with a bottleneck configuration. More specifically, the second end frame 30 has a pair of elongated lateral sides 32, a distal side 34 (comprising a second end 35 of the duvet holder 10), and a proximal side 36. The lateral sides 32 are generally straight and parallel to one another. The distal side 34 is generally straight and perpendicular to the lateral sides 32. The proximal side 36 tapers toward the general middle of the proximal side, where the strap 16 intersects the second shaped end 14. Although the second end frame 30 is shown and described herein as having a rectangular shape with bottleneck configuration, other shapes and/or configurations are possible including but not limited to geometric shapes (e.g. square, rectangular, triangular, circular, elliptical, etc.) and organic shapes (e.g. irregular, free-form, etc), so long as the second shaped end 14 is capable of securely engaging the duvet cover to hold the duvet cover during use. The second end frame 30 is preferably made of a similar material to the first end frame 22 and the strap 16, however other materials may be used without departing from the scope of this disclosure. As with the first shaped end 12, the second shaped end 14 may comprise an engagement element 20 only without a second end frame 30.

The engagement element 20 is configured to temporarily hold a duvet and/or duvet cover in place during use. The engagement element 20 shown by way of example in FIG. 4 comprises an enlarged aperture 38, an axial slit 40, and a lateral slit 42 that work in concert to temporarily receive and securely hold the duvet and/or duvet cover in place during use. Preferably, the aperture 38, axial slit 40, and lateral slit 42 each extend completely through the engagement element 20 such that the duvet holder 10 may be used with either side facing up. In the example shown, the engagement element 20 is configured such that the aperture 38 is positioned nearest the proximal side 36 and the lateral slit 42 is positioned nearest the distal side 34. The axial slit 40 is connected to and extends continuously between the enlarged aperture 38 and the lateral slit 42. The axial slit 40 is preferably centered within the engagement element 20 and is parallel to the lateral sides 32. The axial slit 40 is preferably perpendicular to and connects to the center of the lateral slit 42. Although the engagement element 20 is shown and described herein as having an enlarged aperture 38 axial slit 40, and lateral slit 42, other engagement mechanisms are possible, including but not limited to a clip, a post (that engages with a loop attached to the duvet and/or the duvet cover), a hook-and-loop fastener (configured to mate with a corresponding hook-and-loop fastener provided on the duvet and/or duvet cover), and the like.

By way of example only, the engagement element 20 may be made of a polypropylene material, however other materials may be used in the manufacture of the engagement element 20 without departing from the scope of the disclosure, including but not limited to resilient and flexible materials (e.g. Acrylonitrile Butadiene Styrene Plastic). In the example embodiment described herein, the engagement element 20 is preferably integrally formed with the second end frame 30, however it should be appreciated that the engagement element 20 may be formed independent of the second end frame 30 and then attached to the second end frame 30 by any suitable attachment method, including but not limited to stitching, adhesive, snap-fit, screws, nails, rivets, and pins.

The strap 16 has an elongated configuration and functions as a connector between the first shaped end 12 and the second shaped end 14. By way of example, the strap 16 has a length suitable to accommodate any of a variety of common mattress thicknesses. Alternatively, the duvet holder 10 may be provided in several versions each having a strap 16 of a different length. In a further alternative embodiment, the strap 16 may be adjustable in length. The strap 16 is preferably made of a material that is similar to the first end frame 22 and/or second end frame 30, however other materials may be used, for example including but not limited to plastic, rubber, nylon, canvas, and the like. In the example shown, the strap 16 is integrally formed with the first and second end frames 22, 30, however as an alternative embodiment the strap 16 may be formed independent of the first and/or second end frames 22, 30 and subsequently attached to the first and/or second end frames 22, 30 by any suitable attachment configuration, including but not limited to stitching, adhesive, screws, pins, nails, rivets, and the like. Furthermore, in alternative embodiments the duvet holder 10 may be formed without the first and/or second end frames 22, 30. In such embodiments, the strap 16 may be integrally formed with the first and/or second shaped ends 12, 14. Alternatively the strap 16 may be formed independent of the first and/or second shaped ends 12, 14 and subsequently attached to the first and/or second shaped ends 12, 14 by any suitable attachment configuration, including but not limited to stitching, adhesive, screws, pins, nails, rivets, and the like. As a further alternative, the strap 16 may be integrally formed with one of the first and second shaped ends 12, 14, and formed independent of (and subsequently attached to) the other of the first and second shaped ends 12, 14.

Figure 5:
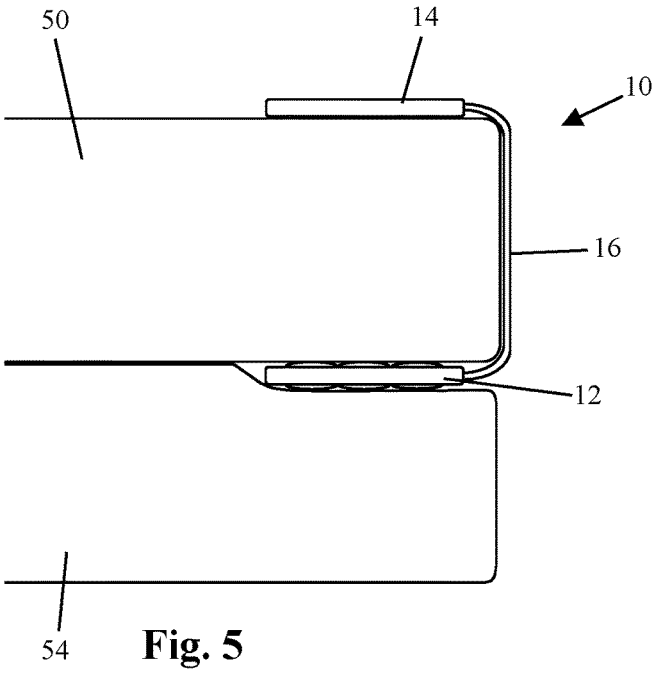
FIG. 5 is a side plan view of the duvet holder of FIG. 1 in place on a mattress in preparation for use.
Figure 6:
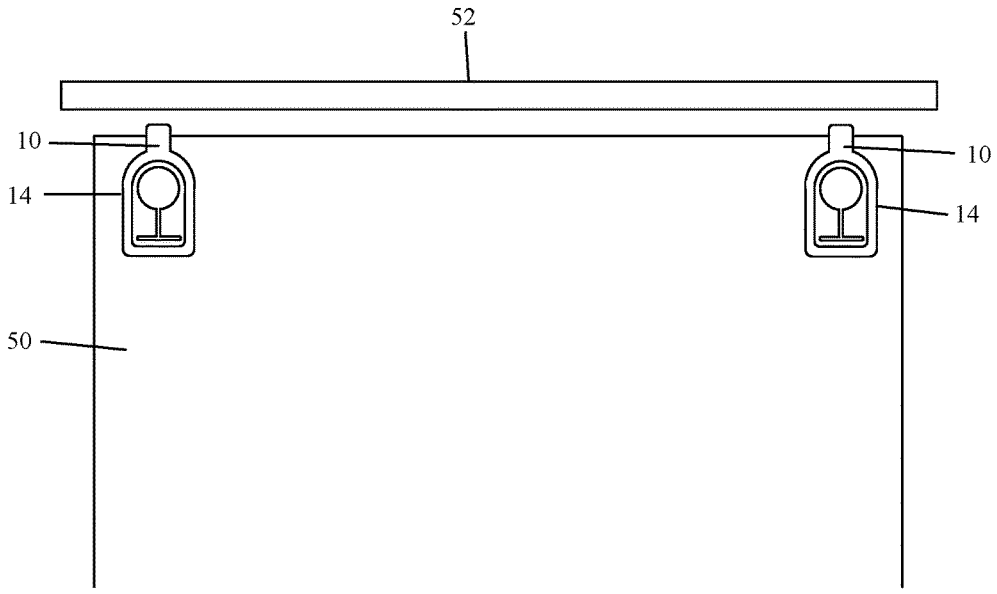
FIG. 6 is a to plan view of a pair of duvet holders of FIG. 1 in place on a mattress in preparation for use.
Figure 7:
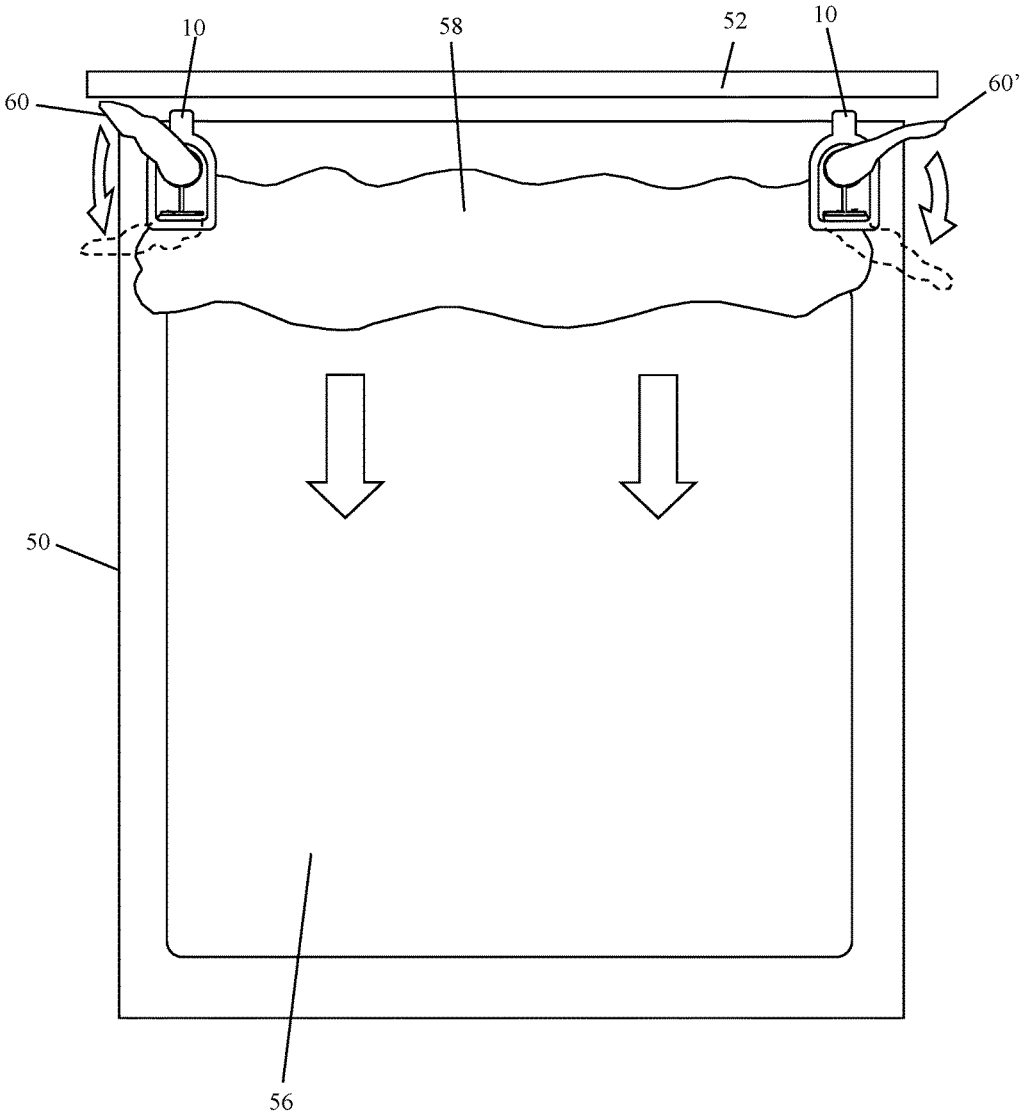
FIG. 7 is a top plan view of the pair of duvet holders in place on a mattress of FIG. 6 engaged with a duvet and duvet cover before the duvet cover has been fully extended over the duvet.
Figure 8:
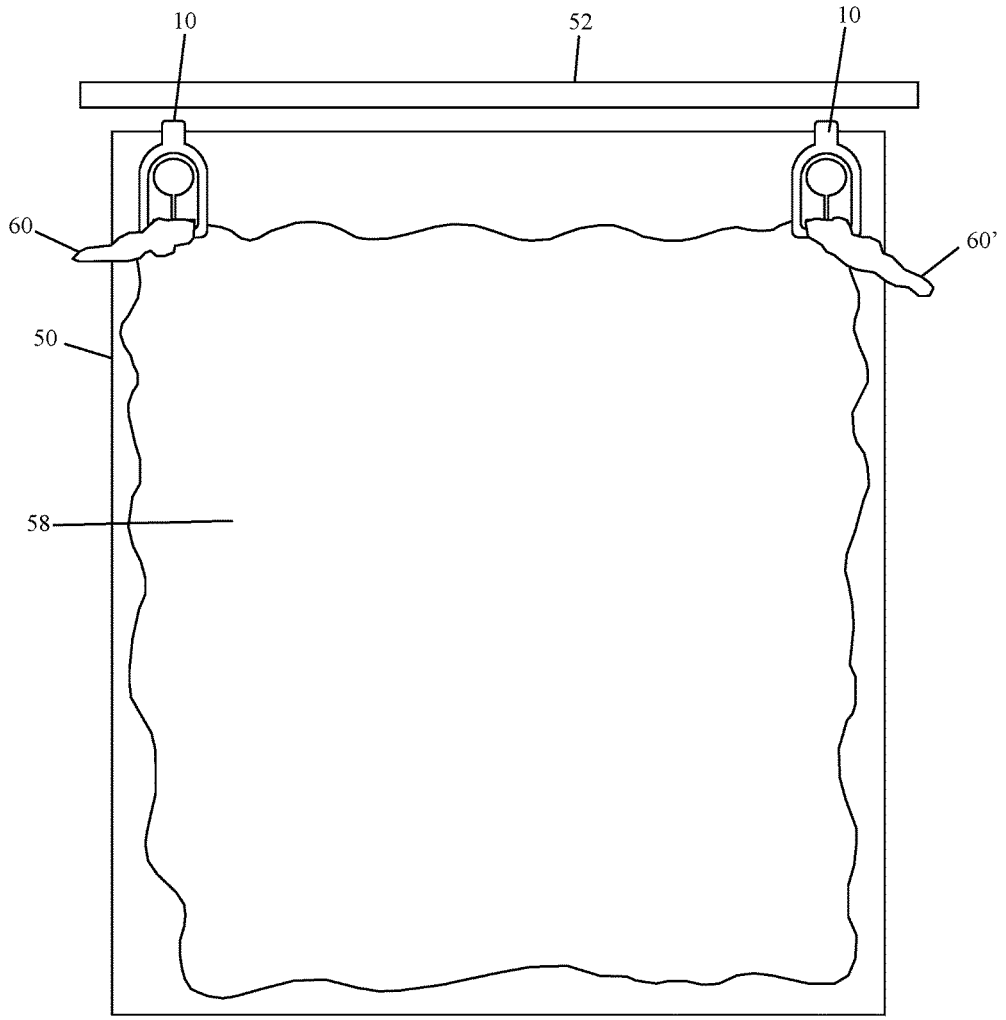
FIG. 8 is a top plan view of the pair of duvet holders in place on a mattress of FIG. 6 engaged with a duvet and duvet cover after the duvet cover has been fully extended over the duvet.

FIGS. 5-8 illustrate a preferred method of using the duvet holder 10. Although the above disclosure pertained to a single duvet holder 10, the preferred use includes a pair of identical duvet holders 10 used in concert. As illustrated in FIG. 5, the first shaped end 12 (including purchase element 18) of a first duvet holder 10 is placed underneath one corner of the mattress 50 at the end of the bed near the headboard 52. By way of example, this placement may be between the mattress 50 and a box spring 54, or the mattress and a bed frame, if applicable. Similarly, the first shaped end 12 (including purchase element 18) of a second duvet holder 10 is paced underneath the other corner of the mattress at the headboard end of the bed. The corresponding second shaped ends 14 (with engagement features 20) are placed on top of the mattress by the headboard in their respective corners of the bed (e.g. FIG. 6). Proper placement of the engagement elements 20 by the headboard and the prevention of excessive slack in the straps 16 can be resolved by pulling the purchase elements 12 down and away from the headboard under the mattress. After the duvet holders 10 are in position, the user then prepares the duvet 56 and duvet cover 58 by inserting two corners of the duvet into the corresponding corners of the duvet cover to form first and second assembled corners 60, 60'. The first assembled corner 60 is pulled through the enlarged aperture 38 of the engagement element 20 of one of the duvet holders 10 until enough of the duvet/duvet cover combination extends beyond the plane of the second shaped end 14. The user then continues to pull first assembled corner 60 downward through the axial slit 40 until it is snuggly secured in the lateral slit 42. The process is repeated for the second assembled corner 60'. When both the first and second assembled corners 60, 60' of the duvet have been secured in the engagement elements 20, the duvet cover 58 can be extended over the rest of the duvet 56 in the conventional fashion. When the duvet cover 58 has been fully extended over the duvet 56 (e.g. FIG. 8), the secured assembled corners 60, 60' can be removed from the engagement element 20 by pulling each assembled corner up and through the axial slit 40 and out of the aperture 38. The duvet holder 10 can then be tucked and stored away underneath the mattress until it is needed again.

What has been described herein is a preferred embodiment of the invention along with some of its variations. The terms, descriptions, and figures used herein are set forth by way of illustration only and are not meant as limitations. While the inventive features described herein have been described in terms of a preferred embodiment for achieving the objectives, it will be appreciated by those skilled in the art that variations may be accomplished in view of these teachings without deviating from the spirit or scope of the invention.

What is claimed is:

1. A holder for securely holding one corner of a duvet inserted into one corner of a duvet cover in place on a mattress to facilitate insertion of the entire duvet into the duvet cover, comprising:

a first end portion, a second end portion, and an elongated connector extending between the first and second end portions, the first end portion configured for placement underneath a mattress and including a purchase element that interfaces with the mattress to prevent the first end portion from moving relative to the mattress, the second end portion configured for placement on top of a mattress and including an engagement element configured to temporarily securely receive therein a portion of a duvet inserted into a duvet cover;

wherein the engagement element comprises an enlarged aperture, an axial slit, and a lateral slit that work in concert to temporarily receive and securely hold the duvet and duvet cover in place during use, the enlarged aperture positioned nearest the elongated connector, the lateral slit positioned near an outer edge, and the axial slit connected to and extending between the enlarged aperture and lateral slit.

2. The holder of claim 1, wherein the first end portion comprises a first shaped end having a width dimension greater than the width dimension of the elongated connector.

3. The holder of claim 1, wherein the first end portion further includes a frame surrounding the purchase element and defining a perimeter of the first end portion.

4. The holder of claim 1, wherein at least one of the first and second end portions is integrally formed with the elongated connector.

5. The holder of claim 1, wherein the purchase element comprises a frictional non-slip material that employs frictional force to gain purchase relative to the mattress.

6. The holder of claim 1, wherein the elongated connector is connected directly to at least one of the purchase element and the engagement element.

7. The holder of claim 1, wherein the second end portion comprises a second shaped end having a width dimension greater than the width dimension of the elongated connector.

8. The holder of claim 1, wherein the second end portion further includes a frame surrounding the engagement element and defining a perimeter of the second end portion.

9. The holder of claim 1, wherein at least one of the first and second end portions is removeably coupled with the elongated connector.

10. The holder of claim 1, wherein the engagement element is made of a flexible, resilient material.

11. A method for inserting a duvet into a duvet cover, comprising:

preparing the duvet and duvet cover by inserting a first corner of the duvet into a first corner of the duvet cover to form a first assembled corner, and inserting a second corner of the duvet into a second corner of the duvet cover to form a second assembled corner;

positioning a first removable duvet holder on a mattress, the first removable duvet holder including a first end portion, a second end portion, and an elongated connector extending between the first and second end portions, the first end portion including a purchase element that interfaces with a mattress to prevent the first end portion from moving relative to the mattress, the second end portion including an engagement element comprising a first enlarged aperture, a first axial slit, and a first lateral slit that work in concert to temporarily receive and securely hold the first assembled corner in place during use, the first enlarged aperture positioned nearest the elongated connector, the first lateral slit positioned near an outer edge, and the first axial slit connected to and extending between the first enlarged aperture and first lateral slit;

positioning a second removable duvet holder on a mattress, the second removable duvet holder including a first end portion, a second end portion, and an elongated connector extending between the first and second end portions, the first end portion including a purchase element that interfaces with a mattress to prevent the first end portion from moving relative to the mattress, the second end portion including an engagement element comprising a second enlarged aperture, a second axial slit, and a second lateral slit that work in concert to temporarily receive and securely hold the second assembled corner in place during use, the second enlarged aperture positioned nearest the elongated connector, the second lateral slit positioned near an outer edge, and the second axial slit connected to and extending between the second enlarged aperture and second lateral slit, the second removable duvet holder positioned such that the first end portion including the purchase element is underneath a second corner of the mattress and the second end portion including the engagement element is on top of the mattress near the second corner;

temporarily attaching the first assembled corner to the engagement element of the first removable duvet holder by pulling the first assembled corner through the first enlarged aperture, first axial slit, and first lateral slit until the first assembled corner is snugly secured within the first lateral slit;

temporarily attaching the second assembled corner to the engagement element of the second removable duvet holder by pulling the second assembled corner through the second enlarged aperture, second axial slit, and second lateral slit until the second assembled corner is snugly secured within the second lateral slit; and extending the remaining portion of the duvet cover over the remaining portion of the duvet so that a third corner of the duvet is inserted into a third corner of the duvet cover and a fourth corner of the duvet is inserted into a fourth corner of the duvet cover.

12. The method of claim 11, wherein at least one of the first and second end portions is removeably coupled with the elongated connector.

13. The method of claim 11, wherein the elongated connector is connected directly to at least one of the purchase element and the engagement element.

14. A method for inserting a duvet into a duvet cover, comprising:

preparing the duvet and duvet cover by inserting a first corner of the duvet into a first corner of the duvet cover to form a first assembled corner, and inserting a second corner of the duvet into a second corner of the duvet cover to form a second assembled corner;

positioning a first removable duvet holder on a mattress, the first removable duvet holder including a first end portion, a second end portion, and an elongated connector extending between the first and second end portions, the first end portion including a purchase element that interfaces with a mattress to prevent the first end portion from moving relative to the mattress, the second end portion including an engagement element comprising a first aperture configured to temporarily securely receive therein at least a portion of the first assembled corner, the first removable duvet holder positioned such that the first end portion including the purchase element is underneath a first corner of the mattress and the second end portion including the engagement element is on top of the mattress near the first corner;

positioning a second removable duvet holder on a mattress, the second removable duvet holder including a first end portion, a second end portion, and an elongated connector extending between the first and second end portions, the first end portion including a purchase element that interfaces with a mattress to prevent the first end portion from moving relative to the mattress, the second end portion including an engagement element comprising a second aperture configured to temporarily securely receive therein at least a portion of the second assembled corner, the second removable duvet holder positioned such that the first end portion including the purchase element is underneath a second corner of the mattress and the second end portion including the engagement element is on top of the mattress near the second corner;

temporarily coupling the first assembled corner with the engagement element of the first removable duvet holder by inserting only the portion of the first assembled corner through the first aperture;

temporarily coupling the second assembled corner with the engagement element of the second removable duvet holder by inserting only the portion of the second assembled corner through the second aperture; and extending the remaining portion of the duvet cover over the remaining portion of the duvet so that a third corner of the duvet is inserted into a third corner of the duvet cover and a fourth corner of the duvet is inserted into a fourth corner of the duvet cover.

15. The method of claim 14, wherein the engagement element is made of a flexible, resilient material.

16. The method of claim 14, wherein the purchase element comprises a frictional non-slip material that employs frictional force to gain purchase relative to the mattress.

17. The method of claim 14, wherein the engagement element of the first duvet holder comprises a first enlarged aperture, a first axial slit, and a first lateral slit that work in concert to temporarily receive and securely hold the first assembled corner in place during use, the first enlarged aperture positioned nearest the elongated connector, the first lateral slit positioned near an outer edge, and the first axial slit connected to and extending between the first enlarged aperture and first lateral slit, and the step of temporarily attaching the first assembled corner to the engagement element of the first removable duvet holder comprises pulling the first assembled corner through the first enlarged aperture, first axial slit, and first lateral slit until the first assembled corner is snugly secured within the first lateral slit.

18. The method of claim 14, wherein the engagement element of the second duvet holder comprises an second enlarged aperture, a second axial slit, and a second lateral slit that work in concert to temporarily receive and securely hold the second assembled corner in place during use, the second enlarged aperture positioned nearest the elongated connector, the second lateral slit positioned near an outer edge, and the second axial slit connected to and extending between the second enlarged aperture and second lateral slit, and the step of temporarily attaching the second assembled corner to the engagement element of the second removable duvet holder comprises pulling the second assembled corner through the second enlarged aperture, second axial slit, and second lateral slit until the second assembled corner is snugly secured within the second lateral slit.

19. The method of claim 14, wherein at least one of the first and second end portions is removeably coupled with the elongated connector.

20. The method of claim 14, wherein the elongated connector is connected directly to at least one of the purchase element and the engagement element.

* * * * *